US007810265B2

(12) United States Patent
Beatty

(10) Patent No.: US 7,810,265 B2
(45) Date of Patent: Oct. 12, 2010

(54) SYSTEM, METHOD, AND DEVICES FOR INSTALLATION OF BANNERS

(76) Inventor: Greg Beatty, 510 Buck Rd., Holland, PA (US) 18966

( * ) Notice: Subject to any disclaimer, the term of this patent is extended or adjusted under 35 U.S.C. 154(b) by 326 days.

(21) Appl. No.: 12/001,095

(22) Filed: Dec. 10, 2007

(65) Prior Publication Data

US 2009/0146029 A1 Jun. 11, 2009

(51) Int. Cl.
*A47G 1/17* (2006.01)
*G09F 15/00* (2006.01)

(52) U.S. Cl. ..... 40/607.14; 40/607.12; 248/206.5; 248/219.4; 116/173

(58) Field of Classification Search ..... 40/661.12, 40/607.14, 607.13; 248/206.5, 218.4, 219.1, 248/219.3, 219.4; 116/173
See application file for complete search history.

(56) References Cited

U.S. PATENT DOCUMENTS

| | | | | |
|---|---|---|---|---|
| 3,241,516 | A * | 3/1966 | Hopkins | 116/173 |
| 3,360,876 | A | 1/1968 | Nestegard | |
| 3,955,786 | A | 5/1976 | Duddy | |
| 4,574,726 | A | 3/1986 | Sullivan | |
| 4,700,655 | A | 10/1987 | Kirby | |
| 4,876,812 | A | 10/1989 | Haralson | |
| 4,880,195 | A | 11/1989 | Lepley | |
| H865 | H | 1/1991 | Sery et al. | |
| 5,320,322 | A * | 6/1994 | Williams | 248/514 |
| 5,400,992 | A * | 3/1995 | Pohl | 248/231.81 |
| 5,409,190 | A * | 4/1995 | Mattox | 248/315 |
| 5,463,973 | A * | 11/1995 | Tait | 116/173 |
| 5,690,317 | A * | 11/1997 | Sandsborg | 256/1 |
| 5,702,081 | A * | 12/1997 | Gallemore, II | 248/218.4 |
| 6,042,080 | A | 3/2000 | Shepherd et al. | |
| 6,233,858 | B1 * | 5/2001 | Brach et al. | 40/660 |
| 6,378,820 | B1 | 4/2002 | Mooney et al. | |
| 7,047,680 | B2 | 5/2006 | Myles | |
| 7,188,821 | B2 | 3/2007 | Curtis | |
| 7,213,356 | B2 | 5/2007 | Haggard, Jr. | |
| 7,389,601 | B1 * | 6/2008 | Guilmet | 40/591 |
| 2002/0166275 | A1 * | 11/2002 | Broadwell et al. | 40/606 |

FOREIGN PATENT DOCUMENTS

| | | |
|---|---|---|
| CA | 0707857 | 4/1965 |
| FR | 1126224 | 11/1956 |

OTHER PUBLICATIONS

Publication—American Machinist, Magnetic bracket, p. 126, Nov. 8, 1945.
Fellers, Spring 2007 Catalog—p. 86, Pole Banner Kits.

* cited by examiner

*Primary Examiner*—Cassandra Davis
(74) *Attorney, Agent, or Firm*—Frank J. Bonini, Jr.; John F. A. Earley, III; Harding, Earley, Follmer & Frailey, P.C.

(57) ABSTRACT

A system, method and bracket for installing banners, including an improved bracket useful for mounting banners to a supporting structure is provided. The bracket is configured with a magnetic feature for facilitating installation of the bracket to a metallic support structure, and may receive banner mounting hardware, such as, for example, banner mounting arms and fastening members, and may be positioned and held on the structure to allow mounting straps to be installed in order to securely mount the bracket to the structure, and complete installation.

5 Claims, 3 Drawing Sheets

SYSTEM, METHOD, AND DEVICES FOR INSTALLATION OF BANNERS

BACKGROUND OF THE INVENTION

1. Field of the Invention

The present invention relates to the field of brackets for mounting banners to a structure.

2. Brief Description of the Related Art

A number of devices exist for installing signage on a structure. Steel or aluminum type signs, for example, may be bolted directly onto a structure with through bolts and nuts, or secured with threaded machine screws. Banners, which are generally constructed from a fabric type of material, often are mounted to a structure with hardware that is sufficiently strong to hold the banner and associated mounting hardware in place. The banner hardware and banners require installation, many times, at elevated altitudes, such as, for example on a light post. Ladders or other lifting equipment, such as, for example, motorized lifts, may be required to reach the location height where the banner is to be installed. In addition, the banner hardware must be carried to the installation location and positioned during installation.

Some examples of banner mounting devices are illustrated in U.S. Patents, including U.S. Pat. No. 6,378,820, issued on Apr. 30, 2002 to Mooney et al. relates to an "Apparatus and Method for Mounting Banners", which discloses structure for mounting using straps; and U.S. Pat. No. 5,463,973 issued Nov. 7, 1995 to Tait which discloses a "Decorative Banner Mounting Kit" that utilizes mounting bands. A banner support is disclosed in U.S. Pat. No. 4,880,195 issued Nov. 12, 1989 to Lepley.

A need exists for an improved banner installation and mounting system and a bracket which may be economically produced, is easy to install, and facilitates improved security under conditions where a securing band may fail.

SUMMARY OF THE INVENTION

A system for installing signage, including a bracket useful for mounting banners to a supporting structure is provided. According to preferred embodiments, the system facilitates installation of banners by enabling the banner and banner hardware to be configured with a bracket prior to the installation of the bracket on a structure.

According to preferred embodiments, the bracket preferably includes a magnetic feature for facilitating installation of the bracket to a metallic support. The bracket is configured to hold hardware for mounting a banner.

According to preferred embodiments, brackets may be used in pairs or groups. For example, according to one preferred installation, two brackets may be used, one bracket being positioned at a first longitudinal location on a support, and another bracket being positioned at a longitudinally spaced distance from the first bracket. The brackets, according to this preferred embodiment, each may be configured to hold mounting hardware, such as, for example, a mounting bar onto which ends of a banner may be installed.

According to other embodiments, brackets may be used in pairs, or other multiples, so that more than one bracket is positioned at the same level (such as back to back, or the like).

The magnetic feature facilitates installation of the bracket by facilitating holding the bracket in position so that the bracket mounting hardware, such as, for example, mounting straps, may be placed on the bracket and tightened there about, permitting completion of the installation. When the installation is completed, the mounting hardware, such as, for example, the mounting straps, secure the bracket in place on the structure.

According to a preferred embodiment, a bracket includes a magnetic feature which may be used for installation and further may remain on the bracket after installation so that if securing hardware, such as, for example, straps should fail or come loose, the bracket may remain attached. This may prevent situations where the bracket drops, and where an individual is leaning on the structure, such as a post, the bracket may cause an injury.

The invention facilitates assembly of a banner on a bracket and further may provide a bracket onto which a banner may be installed prior to securing the bracket on a structure, such as, for example a post. Embodiments of the brackets provide a magnetic feature which permits the bracket to be positioned and held on a metal structure (e.g., structures that have magnetic capability when magnetized with a magnet), and aligned, and thereafter secured with securing straps to the structure. The magnetic feature of the bracket allows the bracket to be held in place while mounting hardware, such as, for example, retaining straps, which may require tools and/or two handed manual maneuvering to install, may be securely attached.

These and other objects and advantages may be provided by the embodiments of the invention, including preferred embodiments exemplified in the description and figures.

BRIEF DESCRIPTION OF THE DRAWING FIGURES

DETAILED DESCRIPTION OF THE INVENTION

Figure 1:
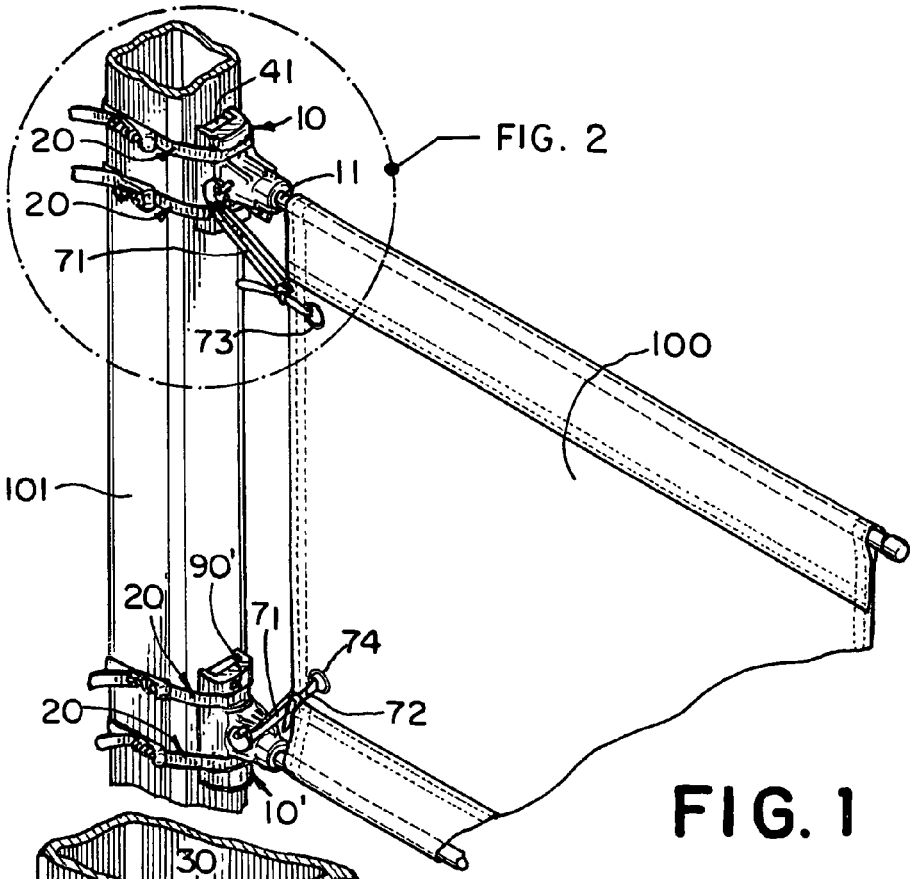
FIG. 1 is a partial perspective view showing a bracket with mounting hardware according to my invention, illustrated in an environment where two brackets are shown in an installed condition mounting a banner to a post structure.
Figure 2:
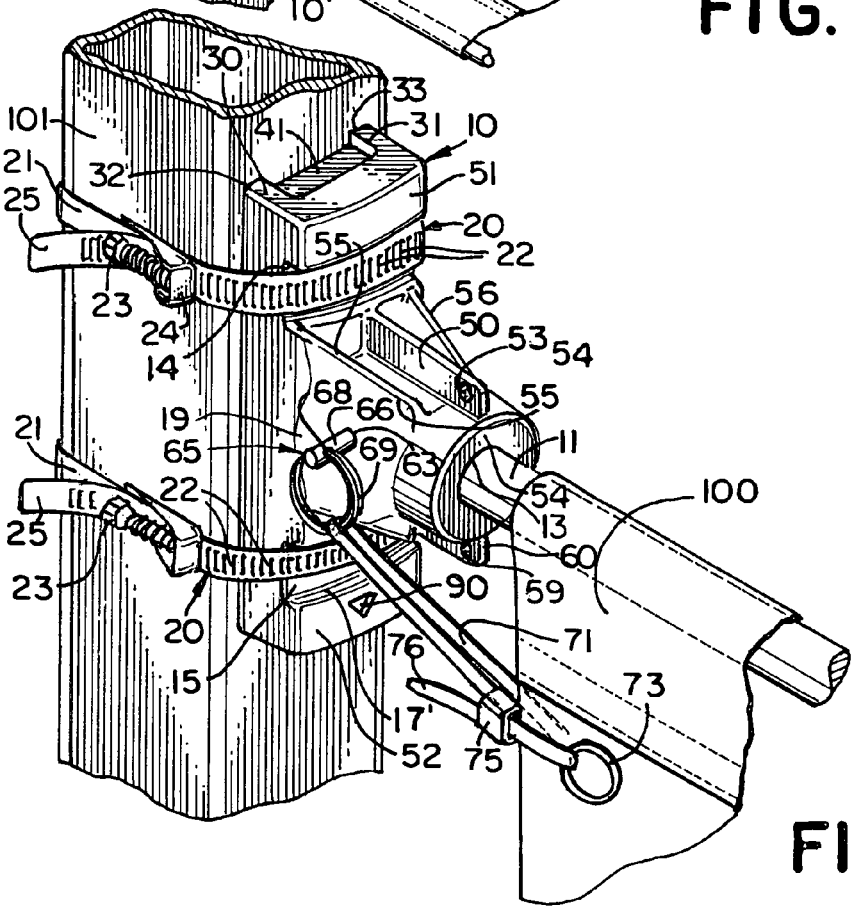
FIG. 2 is a left side perspective view of the upper bracket and mounting hardware shown in FIG. 1, taken from the encircled area represented by the phantom circle shown in FIG. 1.
Figure 3:
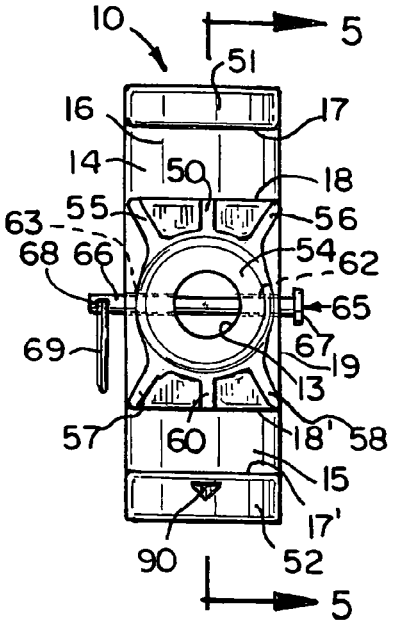
FIG. 3 is a front elevation view of the bracket of FIG. 1, shown separately from the banner and other mounting hardware components, being illustrated with the fastner installed.
Figure 4:
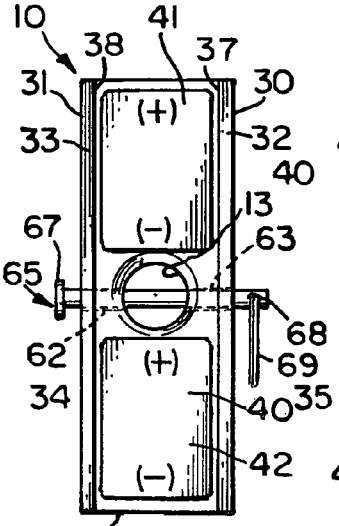
FIG. 4 is a rear elevation view of the bracket of FIG. 3.
Figure 5:
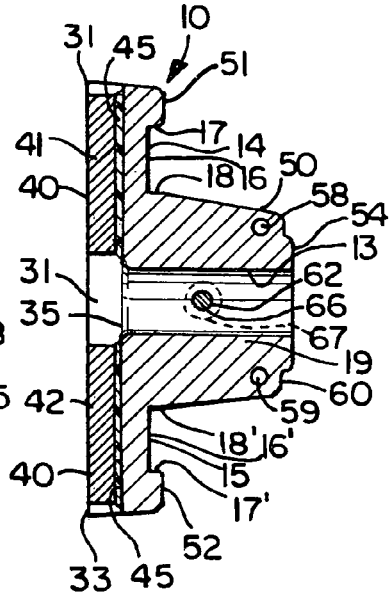
FIG. 5 is a sectional view of the bracket of FIG. 3 taken along the line 5-5 of FIG. 3.

Referring to the drawing FIGS. 1-5, a preferred embodiment of a bracket 10 for mounting banners 100 to a supporting structure 101 is illustrated. The bracket 10 preferably is configured to receive banner holding hardware, such as, for example, banner retention arms 11, 12. Referring to FIGS. 3, 4, and 5, the bracket 10 is shown having a bore 13 therein into which an end of a banner retention arm 11, 12 may be secured.

According to a preferred embodiment, brackets 10 may be installed in pairs, such as, for example, an upper bracket 10 and lower bracket 10'. According to a preferred embodiment, the banner retention arms 11, 12 preferably may be installed within the bracket 10, 10' so that they are positioned parallel to each other (in the case of standard rectangular-shaped banners), and perpendicular to the pole or post). The brackets 10, 10' include a first or upper mounting channel 14 and a second or lower mounting channel 15. Referring to FIG. 5, the upper mounting channel 14 and lower mounting channel 15 are configured as a generally u-shaped recess having a recessed surface portion 16, 16' a first side wall portion 17, 17' and a second side wall portion 18, 18', the recessed surface portion 16, first side wall portion 17 and second side wall portion 18 defining the u-shaped channel 14. The lower mounting channel 15 preferably is configured similar to the upper channel 14, with the recessed surface portion 16', first side wall portion 17' and second side wall portion 18' defining the u-shaped channel 15. The upper mounting channel 14 and lower mounting channel 15 each preferably are sized to accommodate receipt of a retaining member 20.

According to a preferred embodiment, the retaining member 20 includes a metal band 21 having a plurality of threads or grooves 22 therein. A captive screw 23 is provided at one end of the band 21, and there is a slot 24 proximate the captive screw 23 through which the metal band end 25 is fed. When the captive screw 23 is rotated, it functions as a worm drive pulling the threads of the band 21, causing the band to tighten around the bracket 10, and pulling the band 21 into the channel 14 of the bracket 10. A retaining member 20 also may be used for securing the bracket 10 in the location of the lower channel 15.

According to an alternate embodiment (not shown), the retaining member 20 may include stainless steel (or other metal types) banding which may be supplied in a roll and may be cut to lengths suitable for surrounding the bracket (or brackets being installed) and the structure (such as a post). A ratcheting clip (not shown), which is commercially available, may be used to install the banding. For example, the banding may be pulled through the clamp by ratcheting the strap through the clamp, and when a suitable clamping force is achieved to hold the band and bracket tightly in place, the clamp may be crimped to fix the clamp in place.

The bracket 10 may be configured to be installed onto a structure, such as, for example, a post 101. The post 101 may have a planar surface, or alternately may be one having a circumferential surface, such as for example the post 201 shown in FIGS. 10 and 11. The bracket 10 is shown having a preferred configuration which permits the bracket 10 to be installed on a variety of surfaces, including planar or flat surfaces, as well as arcuate or polygonal shaped surfaces (such as hexagonal or octagonal posts).

According to a preferred embodiment, the bracket 10 is illustrated having a pair of legs 30, 31 which define rear surfaces 32, 33 of the bracket 10. The legs 30, 31 are configured to engage a mounting surface, such as for example, a post. The legs 30, 31 are provided to concentrate the force applied by the retaining member 20 on the post to hold the bracket 10 in place. The bracket 10 is shown having a magnetic surface portion 40. The magnetic surface portion 40 is provided on the mounting side of the bracket 10, and is located in a channel 34 defined by the legs 30, 31 and a rear surface 35 of the bracket 10. The magnetic surface portion 40 may be configured from magnetic material. According to a preferred embodiment, the magnetic portion is constructed from a magnetic material of suitable strength to impart a magnetic force great enough to maintain the bracket weight plus the weight of mounting hardware (such as bracket arms, arm fastening hardware) and banners, at least for a duration of time required for the completion of the installation of the bracket 10, 10' by securing it to a mounting structure with a retaining member 20. Preferred examples of a magnetic material include materials selected from the group consisting of rare earth magnets, including for example alloys of the Lanthanide group of elements. Examples of particularly preferred materials that may be used to construct the magnetic element include neodymium iron boron (NeFeB) and samarium cobalt (SmCo).

According to one embodiment, the bracket 10 may be constructed through a molding process where the body 19 of the bracket 10 may be formed using a mold or forging the body, and the magnetic surface 40 applied through the application of a molten magnetic material composition. The molten magnetic composition may include a magnetized or magnetizable metal, in particular including rare earth metals such as those mentioned herein, and a bonding material, such as a plasticizer, epoxy or other compound. According to an alternate embodiment, a mold (not shown) is configured to receive the bracket body 19. The mold has a space and boundary to accommodate a magnetic material which is to be formed as part of the bracket 10. The molten material used to form the magnetic element of the bracket 10 preferably is supplied to the mold. The molten material is permitted to set (through cooling, for example), and the bracket is removed from the mold. According to an alternate embodiment, the mold is provided to form an arcuate configuration of the magnetic surface 40. Referring to FIG. 2, the magnetic surface portion 40 is illustrated according to the example in this preferred embodiment constructed from a first magnetic component 41 and a second magnetic component 42.

According to a preferred embodiment, the first component 41 and second component 42 each are constructed from a magnetic material, and are shown separately attached to the bracket rear surface 35, on opposite longitudinal sides of the central mounting arm holding bore 13. A suitable adhesive 45 may be employed to attach the first magnetic component 41 and second magnetic component 42 to the bracket rear surface 35. Examples of suitable adhesives include epoxy adhesives that are formulated to attach metal to metal components. The adhesive preferably also has properties that providing adherence during cold, hot, or wet conditions, such as those encountered in an outdoor environment.

According to a preferred embodiment, the magnetic surface portion 40 is provided to be approximately at the same relative height as the rear surfaces 32, 33 of the respective legs 30, 31. This facilitates installation of the bracket 10. Where a supporting structure has a planar surface on which the bracket is to be installed, the leg surfaces 32, 33 and magnetic surface portion 40 may engage the supporting structure surface. Where a supporting structure to which a bracket 10 is to be installed has a circumferential surface, the magnetic surface portion may engage a tangential portion of the supporting structure, and the leg edges 37, 38, respectively, may engage the supporting structure.

The magnetic surface portion 40 preferable is constructed from magnetic material (or material which may be magnetized) to provide a magnetic holding force which is equal to or preferably greater than the force of gravity on the mass of the bracket. The bracket 10 therefore may be positioned on the mounting surface structure and preferably, may be retained in place so that the retaining members 20 may be installed.

When the retaining members 20 are installed, the bracket 10 may be fitted with the banner mounting hardware, such as arms, and ultimately, the banner itself. Another option is to premount the banner and banner arms to the bracket 10, preferably using two brackets and two banner arms, and then install the mounted banner unit onto the surface. The banner unit may be held in place so that the retaining members 20 may be installed and tightened on the brackets 10, 10'.

The bracket 10 includes a body portion 19 having a first flange 51 which defines a first or upper channel 14 and a second flange 52 which defines a lower channel 15. A mid portion includes the channel walls 18, 18', and has a bore 13 that preferably extends through the bracket body portion 19. The bore 13 is defined by a circumferential flange 54 and is illustrated having a plurality of strengthening ribs 55, 56, 57, 58. In addition, wings 50, 60 are illustrated each having an aperture 53, 59, respectively, disposed therein at a location proximate the top portion of the circumferential flange 54. The apertures 53, 59 may be used to further secure banner components, such as the banner material, or a banner anchor or tether thereto. Pin bores 62, 63 shown disposed in the side of the circumferential flange portion 54 are provided for facilitating securing of the banner retention arms 11, 12 on the bracket 10. The bores 62, 63 may be dimensioned for receipt of a fastener 65 which is dimensioned to pass through a bore (such as the bore 29 shown in FIG. 11) provided in the end of each of the banner retention arm 11, 12 to retain the arms 11, 12 on the bracket 10. Referring to FIG. 2, the fastener 65 is illustrated according to one embodiment including a shaft portion 66, a head 67 and a through bore 68 provided at an end thereof. A retainer, such as, for example, the split ring 69 is illustrated installed in the through bore 68 to retain the fastener 65 and the mounting arm 11 on the bracket 10. Alternately, fasteners may be configured as a wire or pin, such as the cotter pin 565 shown in FIGS. 10 and 11.

Referring to FIG. 4, the rear of the bracket 10 is illustrated in a preferred configuration showing the magnetic surface portion 40 configured to accommodate space for receiving an end of a banner retention arm 11, 12, should the retention arm 11, 12 be desired to be seated within the space.

According to one embodiment of the invention, a system for installing banners is provided, including one or more brackets 10, a pair of banner retention arms 11, 12, a pair of retaining members 20, and fastener 65 for securing through one or more of the bracket pin bores 62, 63 a banner retention arm 11, 12 which is held in a bore 13. The use of the system is illustrated according to a preferred embodiment shown with a banner installed. Referring to FIG. 1, a pair of brackets 10, 10' is illustrated holding a banner 100. The brackets 10, 10' are shown installed on a post 101. Retaining members 20 shown with the band portion 21 thereof are used to secure the bracket 10, 10', as are the magnetic elements, the first component 41 and second component 42. Banner tethers 71, 72 are illustrated which are shown being secured to the banner 100 and the bracket 10. Each tether 71, 72 passes through a grommet 73, 74, respectively, in the banner 100, and is secured to the fastener split ring 69. The tethers 71, 72 may be constructed having a ridged configuration with a ratcheting or gripping element 75 to secure the tether end 76. The tethers 71, 72 may be those that are commercially available.

Figure 12:
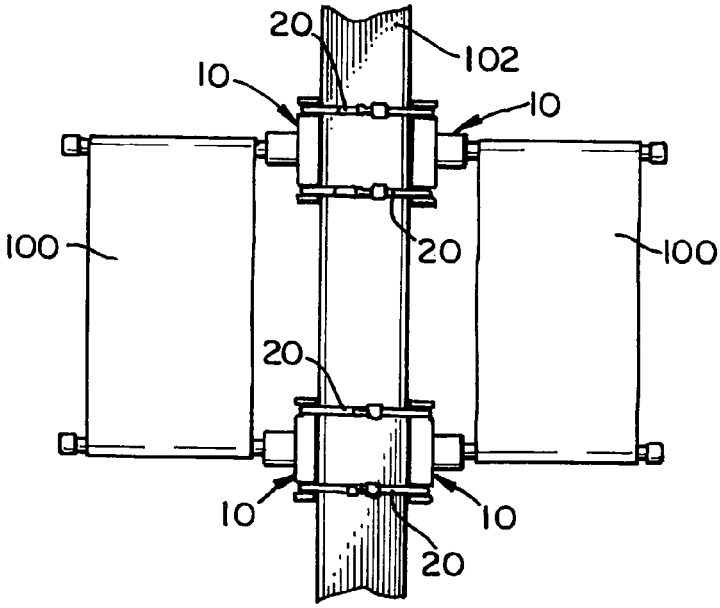
FIG. 12 is a perspective view illustrating an exemplary mounting installation configuration where four brackets are used to mount two banners.

According to an alternate installation, illustrated in FIG. 12, four brackets 10, 10' are provided to be installed in a configuration whereby a retaining member 20 may be applied to secure two brackets 10. According to the illustration shown in FIG. 12#, two upper brackets 10 and two lower brackets 10' are shown placed on opposite sides of the mounting structure, the post 102. Each retaining member 20 includes a strap 21 which passes through the upper channel 15 of each bracket 10 of the upper bracket pair. Another retaining member 20 also includes a strap 21 which passes through the lower channel 14 of each bracket 10 of the upper bracket pair. A lower pair of brackets 10' is shown also held by retaining members 20. The brackets 10, 10' preferably each include a magnetic surface 40. The installation of the brackets 10 preferably is accomplished by positioning the brackets 10 of the upper bracket pair at a desired location and arrangement on the post 102. The brackets 10 are then secured with the retaining members 20. Each retaining member 20 is installed by aligning its strap 21 within or proximate to an upper mounting channel 14. The strap 21 is then secured so it passes through each upper mounting channel 14 of each upper bracket 10 of the upper bracket pair. The lower pair of brackets 10' is installed by placing them on the mounting surface, the post 102, and aligning them to be the desired distance for the height of the banners to be held thereby. The strap 21 of another retaining member 20 is installed in the lower bracket mounting channels 15 of each lower bracket 10' in a similar manner. The upper brackets 10 and lower brackets 10' support two pairs of banner mounting arms 11, 12 and two banners 100, 100'. The magnetic surface 40 facilitates the alignment of the installation in the multi-bracket configuration. The straps 21 of the retaining members 20 may be subject to load forces from external elements such as wind and snow, as well as vibrations from passing motor vehicle traffic, as well as the changes in the weather which may potentially construct or expand structures to which the brackets 10, 10' are installed. According to a preferred embodiment, in the event of the failure of a retaining member 20 including its strap 21 to maintain the loading force to secure the bracket 10, 10', the magnetic elements 41, 42 are provided with a suitable magnetic field that is strong enough to counter the force of the weight of the bracket 10, banner hardware, such as the banner mounting arms, and the banner.

The system when used in a preferred configuration to install banners where bracket pairs 10, 10' are longitudinally spaced from each other, preferably is arranged so that the brackets 10, 10' are installed in a preferred polarity alignment, so that the magnetic elements of an upper bracket 10 are aligned longitudinally the same as the polarity alignment of the magnetic elements of the lower bracket 10'. According to an alternate configuration where a plurality of bracket pairs 10, 10' are installed, such as, for example, back to back configurations where four brackets 10, 10' are utilized to hold two banners 11, preferably, the alignment of each bracket 10, 10' of the plurality of brackets used for the installation are aligned to have corresponding polarities. Optionally, a directional arrow 90, 90' may be provided on each bracket 10, 10'. According to embodiments, for example, where magnetic orientation is desired, the arrows 90, 90' may be used to designate a preferred installment arrangement. A raised boss (not shown) may be provided for sensing orientation in locations where it may be difficult to visually identify the bracket position (e.g., due to wind, darkness, position of the installer, etc.), so that a manual feel of the bracket flange 52 may provide the orientation information. Referring to FIGS. 1 and 2, there are orienting arrows 90, 90' illustrated. According to a preferred installation, brackets 10, 10' may be installed so that the arrows 90, 90', respectively, may be directed to point in the same direction to provide for similar magnetic orientation. According to an alternate installation, the brackets 10, 10' may be installed with the arrows 90, 90' arranged as shown in FIGS. 1 and 2, where the magnetic orientation is oppositely directed.

Figure 6:
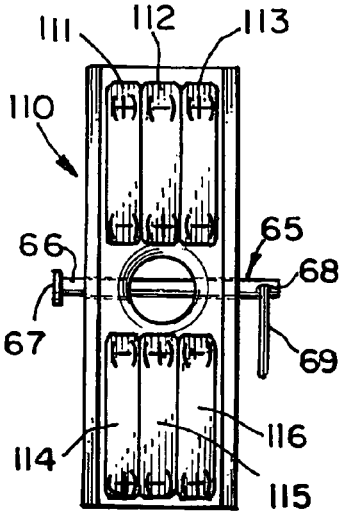
FIG. 6 is a rear elevation view of a second alternate embodiment of a bracket according to my invention.

An alternate embodiment of a bracket 110 is illustrated in FIG. 6. The bracket 110 may be configured similar to the bracket shown in FIGS. 1-5, and includes a magnetic feature having an arrangement of magnetic elements, including a plurality of first or upper magnetic elements 111, 112, 113, and plurality of second or lower magnetic elements 114, 115, 116. The magnetic elements may be disposed in a preferred configuration based on polarity. For example, considering that each magnetic element 111, 112, 113, 114, 115, 116 has a north pole and a south pole, the arrangements designate two similarly arranged polar alignments of the upper outer magnetic elements 111 and 113, and a reversely aligned polarity for the intermediate or adjacent magnetic element 112. Similarly, the second or lower plurality of magnetic elements 114, 115, 116 are aligned in an arrangement with polarity matching the polarity arrangement of the first or upper magnetic elements 111, 112, 113. For example, according to a preferred embodiment, the polarity of upper magnetic elements 111 and 113 would be the same as lower polarity elements 114 and 116, with upper magnetic intermediate or adjacent element 112 being aligned the same as lower magnetic intermediate or adjacent element 115. Referring to FIG. 6, the preferred polarity arrangements are illustrated with plus (+) and minus (−) designations (though the relationship according to preferred embodiments may be a relative one, so that the polarities may be reversed for each element). According to a preferred installation configuration, not shown, the bracket 110 may be installed in pairs, with each bracket 110 oriented in the same direction. Though not shown, a directional indicia, such as an arrow or boss may be applied to the bracket 110 to provide an indication of a direction.

Figure 7:
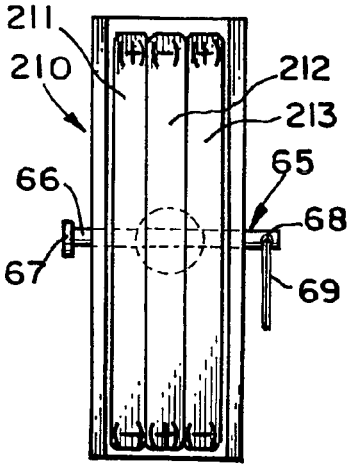
FIG. 7 is a rear elevation view of a third alternate embodiment of a bracket according to my invention.

A third alternate embodiment is illustrated in FIG. 7, showing a bracket 210 with an arrangement of magnetic members, including a pair of outer magnetic members 211, 213, and an adjacent or intermediate magnetic member 212. According to this embodiment, the elements 211, 212, 213 are arranged in alternating polarity, with the outer elements 211 and 213 arranged to have the same polarity alignments, and the intermediate or adjacent element 212 having a reverse polarity alignment relative to the outer elements 211, 213.

Figure 8:
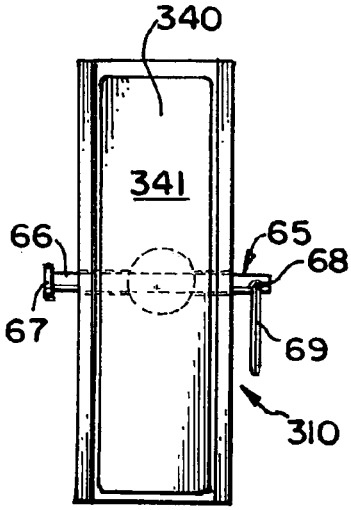
FIG. 8 is a rear elevation view of a fourth alternate embodiment of a bracket according to my invention.

Referring to FIG. 8, a fourth alternate embodiment illustrating a bracket 310 according to the invention is shown in FIG. 8. The bracket 310 includes a magnetic surface 340 provided on the mounting side 350 of the bracket 310. The magnetic surface is provided by a single magnetic element 341.

Figure 9:
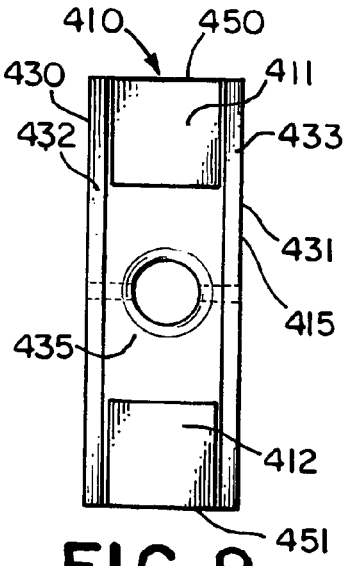
FIG. 9 is a is a rear elevation view of a fifth alternate embodiment of a bracket according to my invention

A fifth alternate embodiment of a bracket 410 is illustrated in FIG. 9 having a bracket body portion 415 and a magnetic surface which is illustrated with magnetic elements 411, 412, provided at opposite longitudinal ends of the bracket 410. Preferably, the magnetic elements 411, 412 are constructed from, or include, a material which is highly magnetic. According to a preferred embodiment, the magnetic elements are made from neodymium iron boron (NdFeB). A preferred composition has the formula $Nd_2Fe_{14}B$. The embodiment illustrated includes magnetic elements 411, 412 which are shown having a square configuration, and dimensioned about one inch on each side, with a thickness of about ⅜ inch. According to a preferred embodiment, the average pull force for each magnetic element 411, 412 is preferably over 50 lbs and more preferably about 87 lbs or greater. The average pull force is the force determined by taking an average of five samples of magnets having 1 inch by 1 inch dimensions and having a thickness of ⅜. The testing to obtain the pull force value for each sample is accomplished by placing the magnet between two 1" thick flat ground plates of alloy steel, where one plate is attached to a force gauge. The force gauge records the tensile force on the magnet. The plates are pulled apart until the magnet disconnects from one of the plates. The peak value recorded by the force gauge is the "pull force". The magnetic elements preferably are constructed to handle both pull forces as well as shear forces. According to a preferred embodiment, two magnetic elements 411, 412 are provided, and each has a pull force of about 87 lbs.

An adhesive, such as, for example, an epoxy compound, is used to attach the magnetic elements 411, 412 to the rear surface 435 of the bracket 410. The magnetic elements 411, 412 are illustrated in a preferred configuration where they are arranged proximate to the upper and lower edges 450, 451 of the bracket 410. According to the embodiment illustrated, the magnetic elements 411, 412 are shown in one preferred dimensional configuration where the magnetic elements are substantially aligned with the rear surfaces 432, 433 of the respective bracket legs 430, 431. According to an alternate configuration, the magnetic elements 411, 412 may be recessed from plane of the rear surfaces 432, 433.

Figure 10:
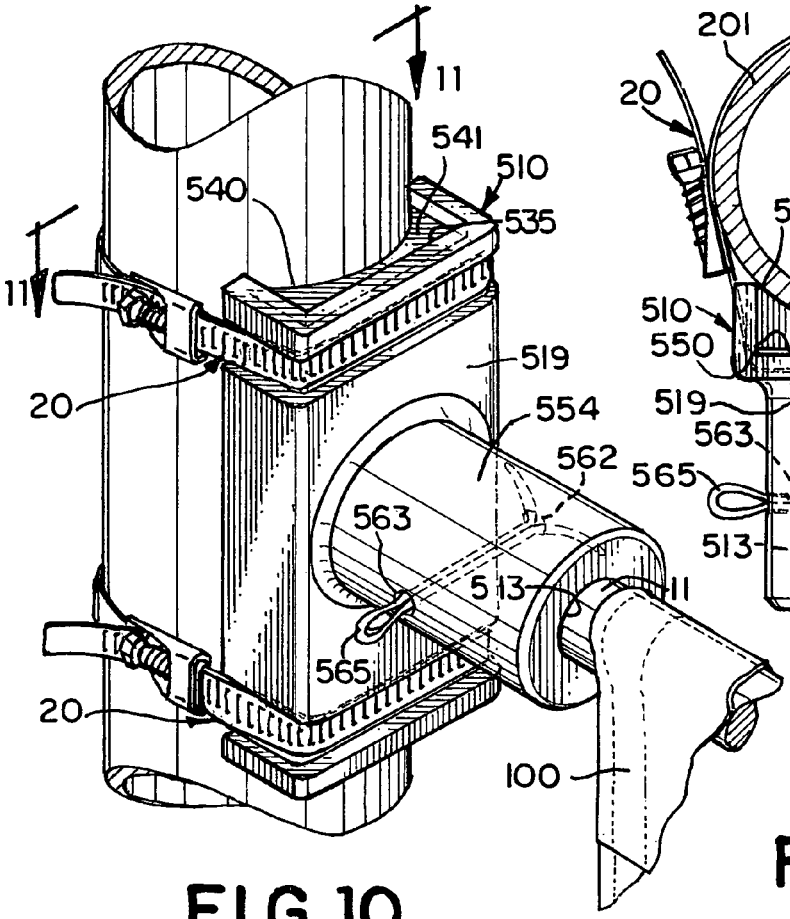
FIG. 10 is a rear perspective view of a sixth alternate embodiment of a bracket according to my invention.
Figure 11:
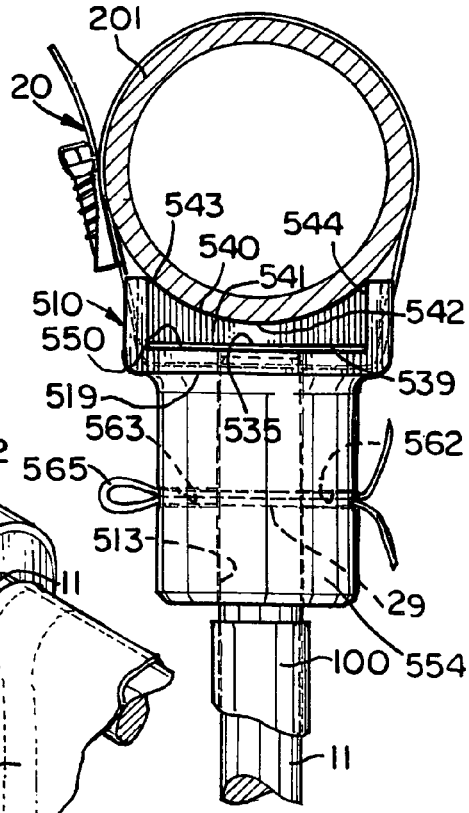
FIG. 11 is a top plan view of the bracket embodiment shown in FIG. 10.

A sixth alternate embodiment of a bracket 510 is illustrated in FIGS. 10 and 11 showing a magnetic member 541 having a surface portion 540 including a curved surface portion 542. The curved surface portion 542 is shown configured as the mounting side surface, there being a bracket facing surface 539 which preferably secures the magnetic member 541 to the bracket rear surface 535. The bracket body 519 has a flange 554 with a bore 513 therein for facilitating mounting banner of a mounting arm 11, 12 therein. Pin receiving bores 563 and 562 are shown provided in the flange 554. A fastener, such as for example a pin assembly 65 illustrated herein, or the cotter pin 565 shown in FIGS. 10 and 11 may be used to secure a banner mounting arm 11, 12 to the bracket 510. The cotter pin 565 is shown installed in the pin receiving bores 562, 563, and passing through the bore 29 of the mounting arm 11. The surface portion 540 includes a first edge 543 and a second edge 544 laterally disposed on each lateral side of the curved surface portion 542. The embodiment illustrated in FIGS. 10 and 11 provides a preferred configuration for facilitating installation of the bracket 510 to certain curved structures, such as poles 201 and the like. The curved surface portion 542 and the bracket legs 530, 531, provide a plurality of tangential engagement locations for facilitating mounting of the bracket 510 to a structure.

According to embodiments of the invention, the brackets may be installed with a banner and one or more components already assembled. For example, according to a preferred method, the brackets, such as any of those 10, 10', 140, 210, 310, 410, and 510, may be configured with a banner mounting arm 11, 12 secured thereto, and further may include a banner 100 installed thereon. The assembled banner 100 and bracket may be installed as a unit. For example, a number of bracket and banner assembly units may be prepared so that they may be readily available for installation on a structure. According to embodiments of the method, a bracket and banner assembly may be magnetically positioned and aligned on a metal structure surface, and held there for installation of the retaining straps to complete the installation of the banner. The assembly unit may include a pair of brackets and a pair of banner mounting arms 11, 12 fastened to the brackets and even tethers holding the banner to the brackets.

While the invention has been described with reference to specific embodiments, the description is illustrative and is not to be construed as limiting the scope of the invention. For example, though split ring type fasteners and cotter pins are illustrated with preferred embodiments, either may be used. Various modifications and changes may occur to those skilled in the art without departing from the spirit and scope of the invention described herein and as defined by the appended claims.

What is claimed is:

1. A system for installing banners using multiple brackets comprising:

a) a plurality of brackets, each bracket having a front and a back, wherein the back comprises a mounting side of said bracket and has a pair of legs which define a pair of rear surfaces of the bracket and define a channel therebetween, wherein said legs are configured to engage a mounting surface, b) a magnetic portion provided on the mounting side of each bracket and being located in said channel defined by said pair of legs, wherein said magnetic portion is constructed from a first magnetic component and a second magnetic component, and wherein said first magnetic component and said second magnetic component are arranged having their polarities longitudinally aligned;

c) each bracket comprising a body having a circumferential flange portion;

d) a bore provided in said bracket, said bore extending through said circumferential flange portion;

e) a pair of apertures disposed in said circumferential flange portion and communicating with said bore, said apertures being located on the flange at diametrically opposite positions relative to each other;

f) mounting arms, each mounting arm comprising a fiberglass rod dimensioned at at least one end thereof for receipt within said bore;

g) a diametrically disposed bore provided in said at least one dimensioned end of each said mounting arm;

h) fastening members for securing said mounting arm to said bracket;

i) said fastening members each including at least one substantially elongate member having a head on one end thereof and a diametrically disposed bore at the other end thereof, said head being sized larger than said aperture of said flange of said bracket to limit movement of said elongate member in a first direction; said elongate member being dimensioned to be received within the apertures of the circumferential flange portion of the bracket and within each diametrically disposed mounting arm bore, j) said fastening members each further comprising a securing element configured to attach to said diametrically disposed bore of said elongate member, said securing element comprising a split key ring;

k) an upper channel and a lower channel provided on said bracket;

l) retaining members, each retaining member having a band with a plurality of threads disposed therein, a captive screw assembly including a captive screw provided at one end of the band, a slot proximate the captive screw through which the other end of the band is fed, wherein when the captive screw is rotated it functions as a worm drive pulling the threads of the band and causing the band to tighten around the bracket, the band and upper and lower channels of said bracket being dimensionally sized such that the band may be received within the channel when said band is installed.

2. A system for installing a banner to a surface, the system including:

two brackets, each bracket having a banner holding side and a surface mounting side, each said bracket having a bore therein adapted for receipt of a banner mounting arm, and having a magnetic portion on said mounting side of said bracket;

a pair of banner mounting arms, a pair of fasteners for fastening said mounting arms to said brackets, two pair of retaining members for securing said brackets to a mounting surface;

wherein said magnetic portion includes at least one magnetic element;

wherein a plurality of magnetic elements are provided; and wherein said plurality of magnetic elements includes two magnetic elements that are longitudinally disposed on said mounting side of each said bracket and are longitudinally spaced apart from each other, and an intermediate magnetic element disposed between said two longitudinally disposed magnetic elements, wherein said two longitudinally disposed spaced apart magnetic elements are arranged with their polarities aligned, and wherein said intermediate magnetic element is arranged with its polarity opposite of that of said two spaced apart magnetic elements.

3. A method for installing a banner on a structure, the method comprising:

a) providing a bracket comprising:

a front a back, wherein the back comprises a mounting side of said bracket and has a pair of legs which define a pair of rear surfaces of the bracket;

a channel defined between said pair of legs;

a magnetic portion provided on the mounting side of the bracket and being located in said channel, wherein said magnetic portion includes at least one magnetic component;

the bracket having a body with a flange portion;

a bore provided in the flange portion; and securing means for securing a mounting component in said bore;

b) magnetically attaching the bracket to a supporting structure;

c) aligning the bracket in a desired position for installation; and d) installing retaining straps on the bracket while the bracket is magnetically attached to the supporting structure in the desired position.

4. The method of claim 3, further including installing a banner mounting arm on the bracket before said bracket is magnetically attached to said supporting structure.

5. The method of claim 4, including installing a banner on said banner mounting arm before said bracket is magnetically attached to said supporting structure.

* * * * *